US008781370B2

(12) United States Patent
Sato

(10) Patent No.: US 8,781,370 B2
(45) Date of Patent: Jul. 15, 2014

(54) DEVELOPER UNIT FOR AN IMAGE FORMING APPARATUS

(75) Inventor: Shougo Sato, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 204 days.

(21) Appl. No.: 12/979,127

(22) Filed: Dec. 27, 2010

(65) Prior Publication Data

US 2011/0158701 A1 Jun. 30, 2011

(30) Foreign Application Priority Data

Dec. 25, 2009 (JP) ..... 2009-295333

(51) Int. Cl.
*G03G 15/08* (2006.01)

(52) U.S. Cl.
USPC ..... 399/256; 399/252; 399/254

(58) Field of Classification Search
CPC ..... G03G 15/0839; G03G 15/0891; G03G 2215/0827
USPC ..... 399/222, 234, 252, 254, 256, 264, 274
See application file for complete search history.

(56) References Cited

U.S. PATENT DOCUMENTS

| | | | | |
|---|---|---|---|---|
| 5,512,984 | A * | 4/1996 | Kimura et al. | 399/228 |
| 5,781,838 | A | 7/1998 | Suzuki | |
| 5,867,756 | A | 2/1999 | Suzuki et al. | |
| 5,995,789 | A * | 11/1999 | Murakami et al. | 399/262 |
| 7,333,755 | B2 * | 2/2008 | Koido | 399/254 |
| 2005/0196184 | A1 | 9/2005 | Koyama et al. | |
| 2006/0024090 | A1 | 2/2006 | Koido | |
| 2006/0045573 | A1 * | 3/2006 | Yamaguchi et al. | 399/254 |
| 2006/0216046 | A1 | 9/2006 | Hatakeyama | |
| 2009/0016775 | A1 | 1/2009 | Naruge | |
| 2011/0123230 | A1 * | 5/2011 | Suenami et al. | 399/254 |

FOREIGN PATENT DOCUMENTS

| | | | |
|---|---|---|---|
| JP | H08-015983 | A | 1/1996 |
| JP | H08-030084 | A | 2/1996 |
| JP | H08-095364 | A | 4/1996 |
| JP | H09-319199 | A | 12/1997 |
| JP | H09-319203 | A | 12/1997 |
| JP | 2000-131947 | A | 5/2000 |
| JP | 2003-114576 | A | 4/2003 |
| JP | 2005-250362 | A | 9/2005 |

(Continued)

OTHER PUBLICATIONS

Japan Patent Office, Notification of Reasons for Rejection for Japanese Patent Application No. 2009-295333, dispatched Nov. 22, 2011.

(Continued)

*Primary Examiner* — David Gray
*Assistant Examiner* — Michael Harrison
(74) *Attorney, Agent, or Firm* — Baker Botts L.L.P.

(57) ABSTRACT

A developer unit for an image forming apparatus is provided. The developer unit includes a developer device having a developer agent carrier, a developer agent supplier, and a restricting member, a developer agent container, which contains the developer agent, and a plurality of conveyers, including a first conveyer and a second conveyer, to convey the developer agent in an axial direction of the developer agent supplier. The first conveyer and the second conveyer are arranged along a circumference of the developer agent supplier and in parallel with the first conveyer.

9 Claims, 11 Drawing Sheets

(56) References Cited

FOREIGN PATENT DOCUMENTS

| | | | |
|---|---|---|---|
| JP | 2006-047470 | A | 2/2006 |
| JP | 2006-267528 | A | 10/2006 |
| JP | 2007-041327 | A | 2/2007 |
| JP | 2007-248963 | A | 9/2007 |
| JP | 2007-304453 | A | 11/2007 |
| JP | 2008-191573 | A | 8/2008 |
| JP | 2008-276094 | A | 11/2008 |
| JP | 2009-020434 | A | 1/2009 |
| JP | 2009-175635 | A | 8/2009 |
| JP | 2009-210670 | A | 9/2009 |

OTHER PUBLICATIONS

State Intellectual Property Office of the People'S Republic of China, The First Office Action for Chinese Patent Application No. 201010623211.2, mailed May 9, 2012.

* cited by examiner

DEVELOPER UNIT FOR AN IMAGE FORMING APPARATUS

CROSS REFERENCE TO RELATED APPLICATION

This application claims priority from Japanese Patent Application No. 2009-295333, filed on Dec. 25, 2009, the entire subject matter of which is incorporated herein by reference.

BACKGROUND

1. Technical Field

An aspect of the present invention relates to a developer unit for an image forming apparatus, in which developer agent is supplied to an electrostatic latent image formed on a photosensitive latent image carrier.

2. Related Art

An image forming apparatus for forming an image on a recording medium with a developer unit has been known. The developer unit is often provided with a developer roller to carry a developer agent on a surface thereof, a supplier roller to supply the developer agent to the developer roller, and an auger to carry the developer agent in a direction of an axis of the supplier roller to supply the developer agent to the supplier roller. The developer unit may be provided with two augers, which are arranged vertically overlapping positions with one being arranged above the other. In particular, one of the augers may be arranged in adjacent to the supplier roller in a lower position, and the other may be arranged above the one in the lower position. According to this arrangement, the developer agent can be moved along the augers to be carried to the supplier roller.

SUMMARY

In the developer unit with two augers, in particular, one of the augers may be arranged in adjacent to the supplier roller in a lower position, and the other may be arranged above the one in the lower position. In other words, solely one of the augers is arranged in the vicinity of the supplier roller. Therefore, the auger at the lower position may move the developer agent in neighboring regions, but the developer agent distributed in regions away from the lower auger tends to reside thereat without being affected by rotation of the lower auger. Further, when solely one auger is arranged in the vicinity of the supplier roller, capacity of the auger to convey the developer agent may depend on a design of the sole auger, and density of the developer agent around the auger may vary. When the density of the developer agent carried by the auger varies, ultimately, the developer roller may not be evenly supplied with the developer agent. Unevenly supplied developer agent may cause irregular printing in the image forming apparatus. Moreover, when the augers are arranged in vertically overlapping positions, a casing to accommodate the augers is required to have a substantial height. When the developer agent accumulates in the casing with substantial height, the components (e.g., the supplier roller and the developer roller) in the lowermost section in the casing are subjected to higher pressure of the developer agent. Thus, excessive pressure of the developer agent on the components may cause uneven supply of the developer agent to the developer roller and may cause irregular printing. Further, when the pressure of the developer agent in the casing increases, the developer agent may leak out of the casing through a contact area between the components.

In view of the above deficiencies, the present invention is advantageous in that a developer unit, in which retention of a developer agent is prevented, and uneven supply of the developer agent to the developer roller is restrained, is provided.

According to an aspect of the present invention, a developer unit for an image forming apparatus is provided. The developer unit includes a developer device having a developer agent carrier, which rotatably carries a developer agent on a surface thereof, a developer agent supplier, which supplies the developer agent to the developer agent carrier, and a restricting member, which scrapes the surface of the developer agent carrier to restrict thickness of the developer agent on the surface of the developer agent carrier. The developer unit further includes a developer agent container, which contains the developer agent, and a plurality of conveyers, including a first conveyer and a second conveyer, to convey the developer agent in an axial direction of the developer agent supplier. The first conveyer and the second conveyer are arranged along a circumference of the developer agent supplier and in parallel with the first conveyer.

BRIEF DESCRIPTION OF THE ACCOMPANYING DRAWINGS

Figure 7A:
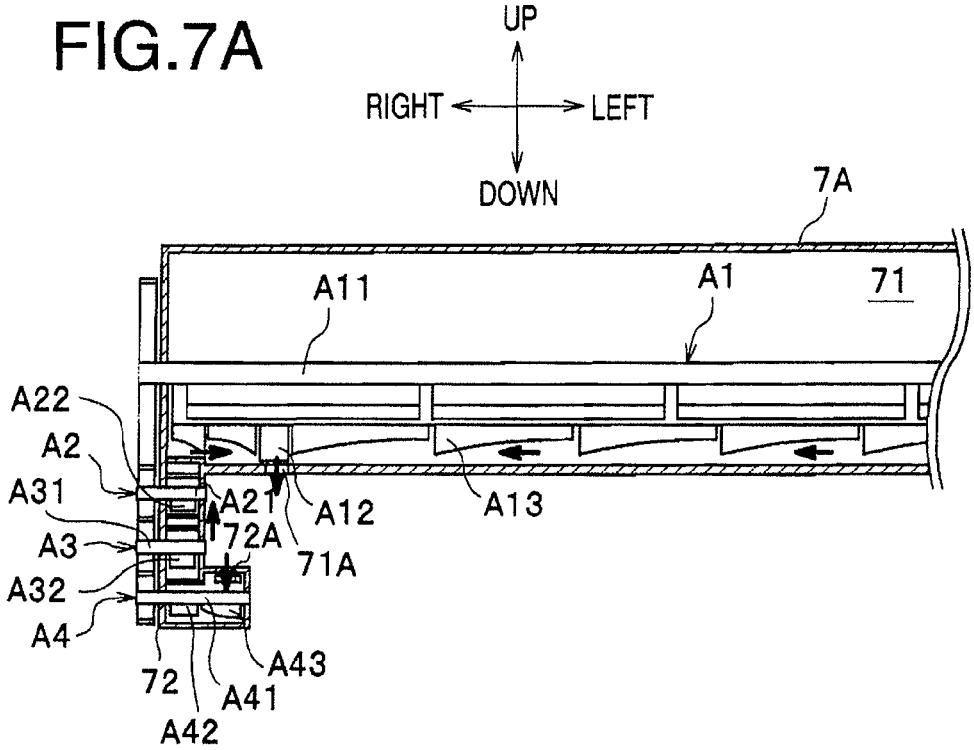
Figure 7B:
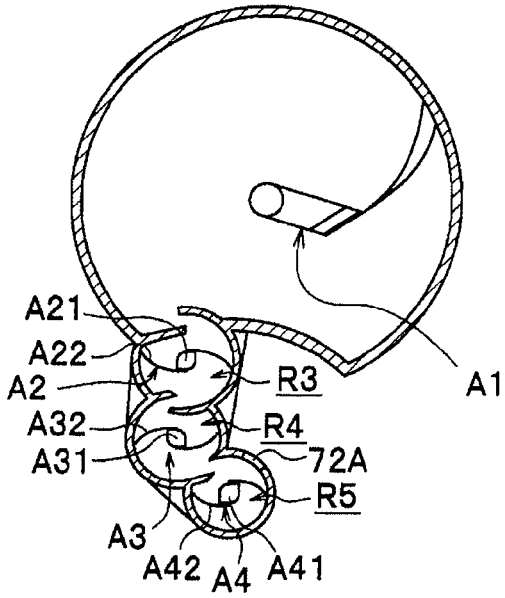

FIG. 7A is a partial and cross-sectional front view of a developer cartridge taken from an axial position of an agitator of the developer cartridge according to the embodiment of the present invention. FIG. 7B is a cross-sectional side view of the developer cartridge according to the embodiment of the present invention taken from a line perpendicular to the axial direction of the agitator of the developer cartridge.

Figure 8A:
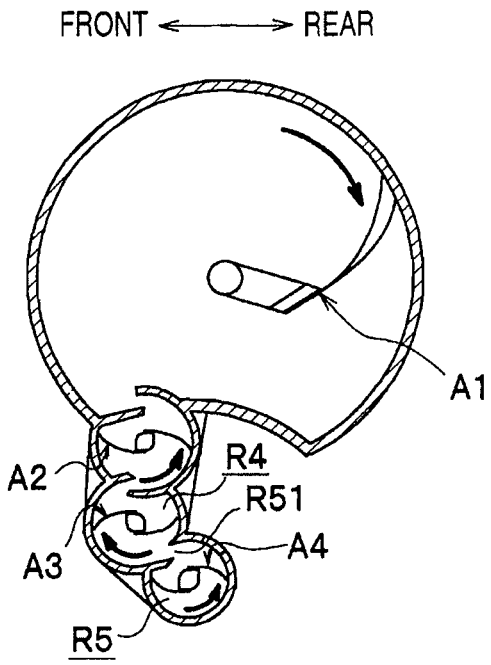
Figure 8B:
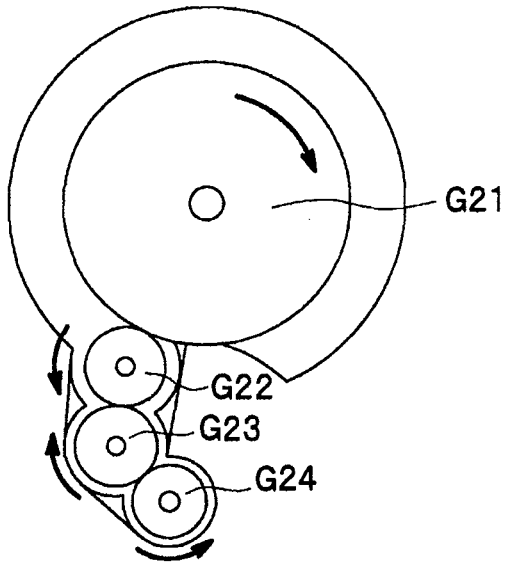

FIG. 8A is a cross-sectional side view of the developer cartridge to illustrate a rotation direction of the agitator according to the embodiment of the present invention. FIG. 8B is a side view of the developer cartridge to illustrate engagement of gears in the agitator according to the embodiment of the present invention.

Figure 9:
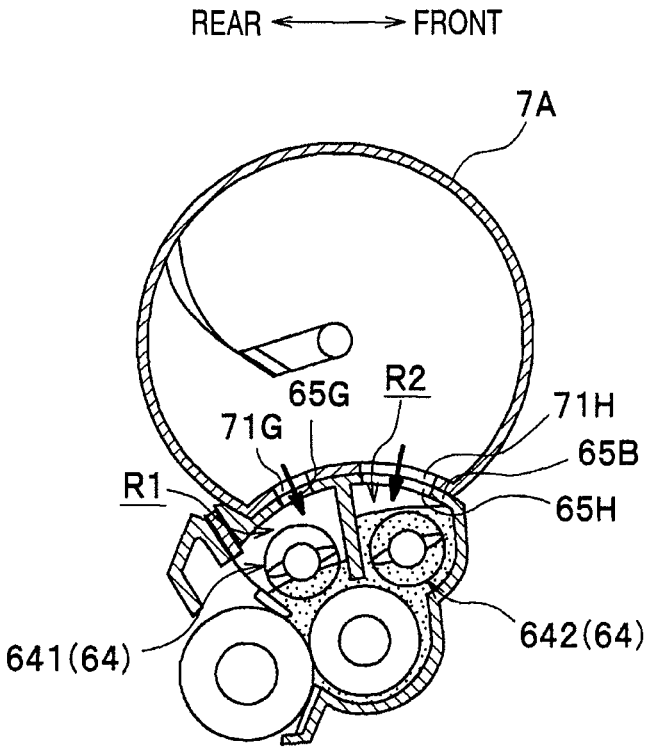

FIG. 9 is a cross-sectional side view of the developer unit with two feeding holes and two collecting holes according to a different embodiment of the present invention.

Figure 10:
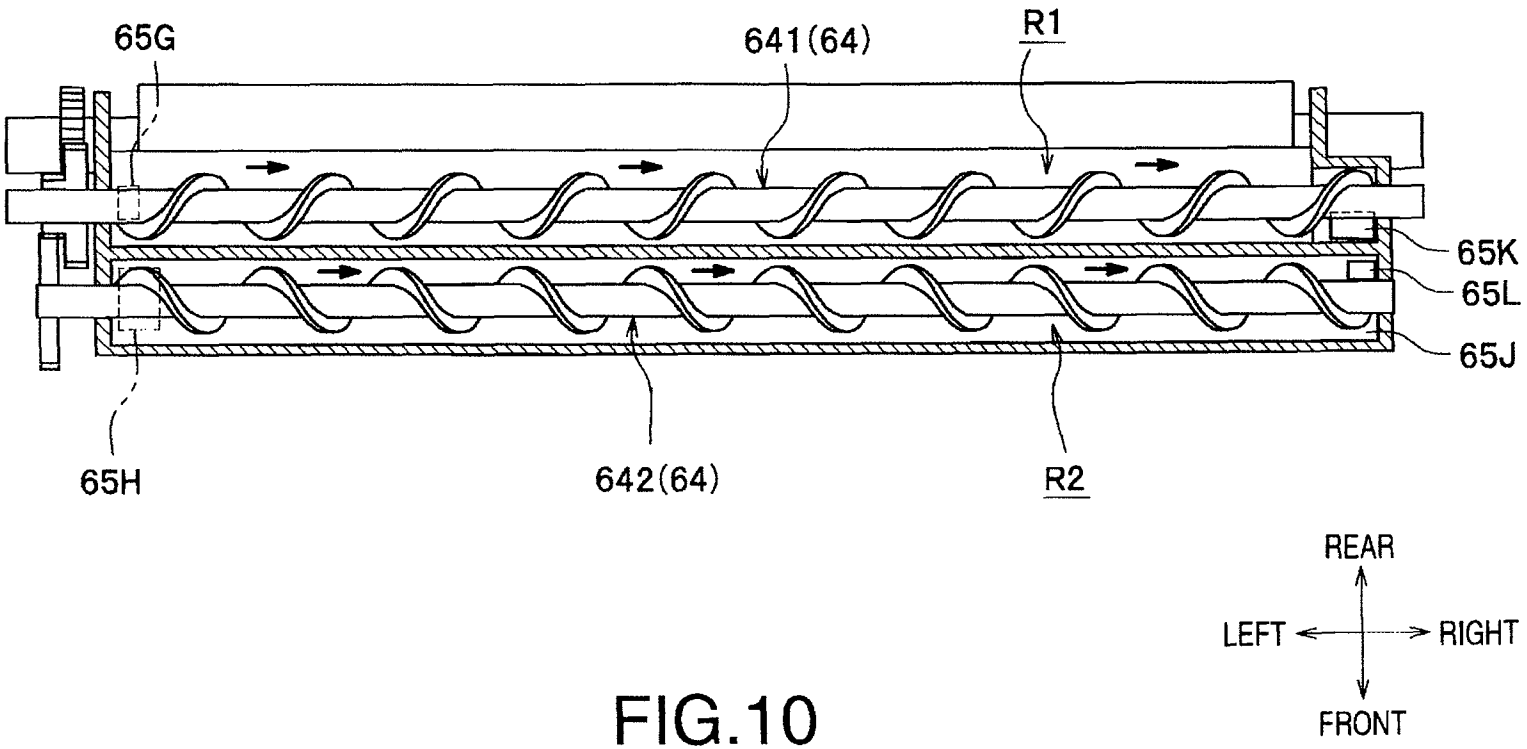

FIG. 10 is a cross-sectional view of the developer unit shown in FIG. 9 according to the different embodiment of the present invention taken from the axial direction of the auger.

Figure 11:
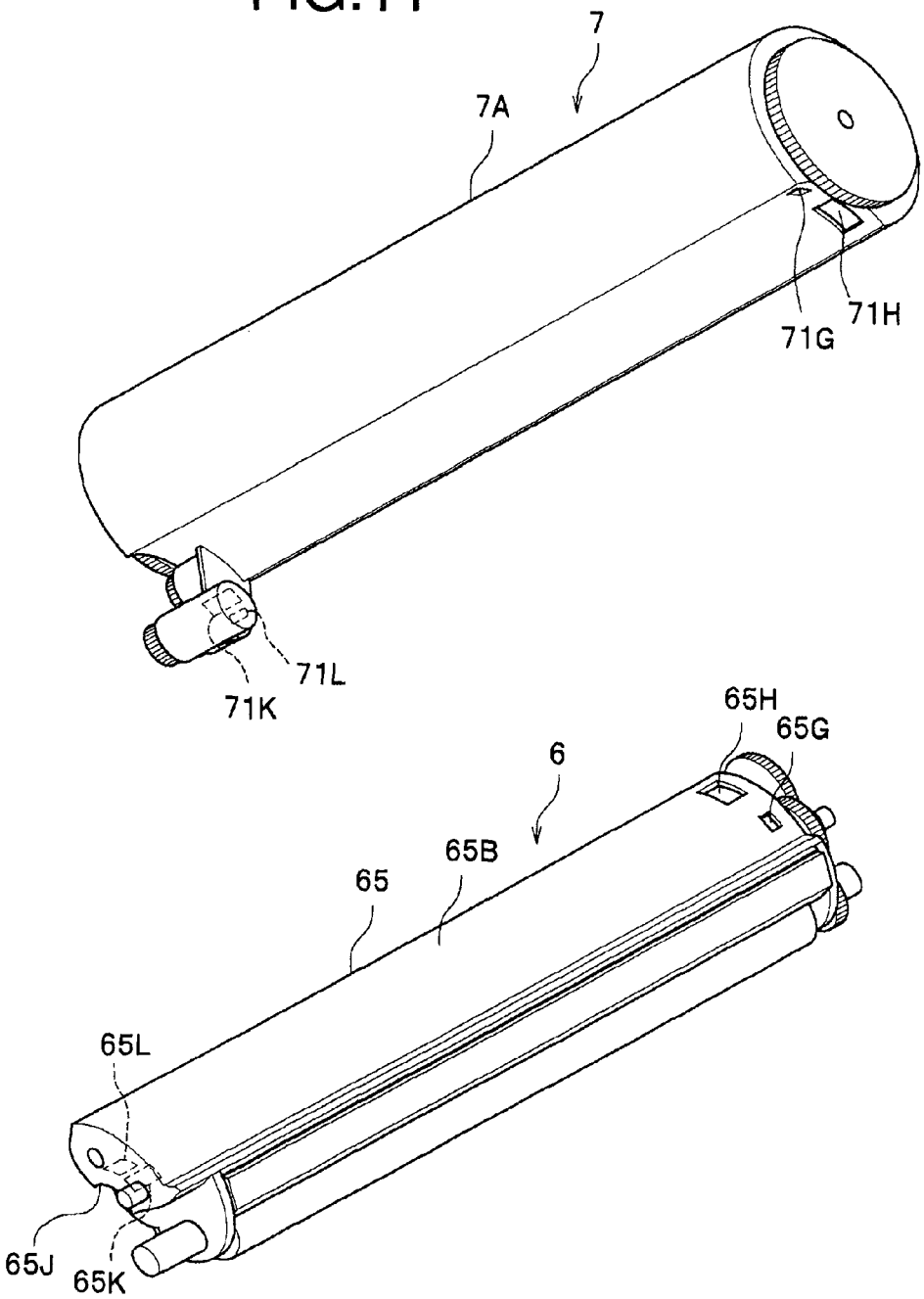

FIG. 11 is an exploded view of the developer unit shown in FIG. 9 according to the different embodiment of the present invention.

DETAILED DESCRIPTION

Hereinafter, an embodiment of the present invention will be described with reference to the accompanying drawings. A color printer 1 represents an image forming apparatus having a developer unit DU according to the present invention.

Overall Configuration of the Printer

Figure 1:
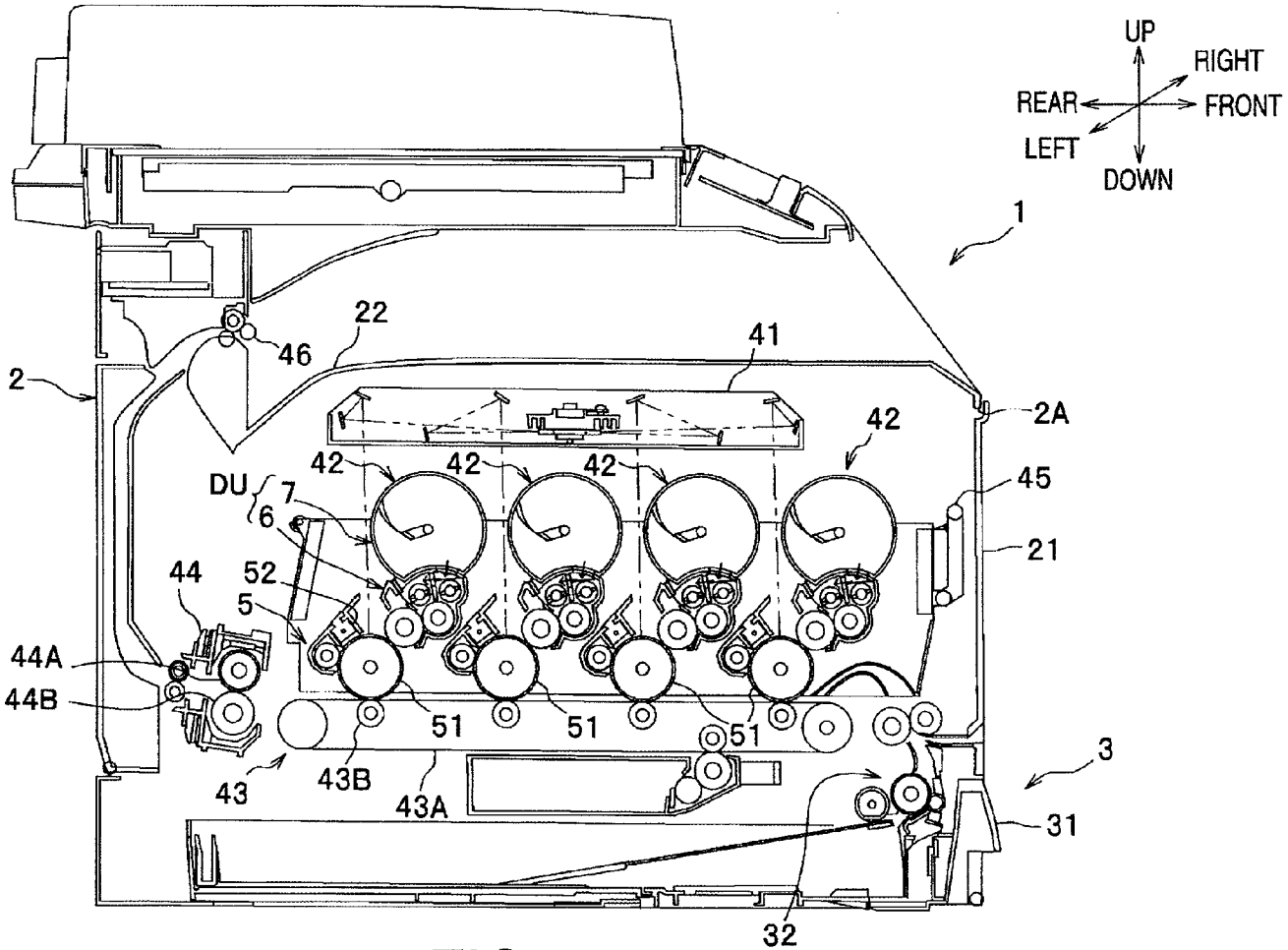
FIG. 1 is a schematic cross-sectional view of a color printer having developer units according to an embodiment of the present invention.

In the present embodiment, directions concerning the printer 1 will be referred to in accordance with orientation of the printer 1 shown in FIG. 1. That is, a viewer's right-hand side appearing in FIG. 1 is referred to as a front side of the printer 1, and a left-hand side, which is opposite side from the front side, is referred to as rear. Further, a viewer's nearer side is referred to as left, and a further side is referred to as right. Furthermore, vertical (up-down) direction of the printer 1 corresponds to an up-down direction appearing in FIG. 1. In FIGS. 3, 5-10, directions of the drawings are as indicated by arrows.

As shown in FIG. 1, the printer 1 includes a main body 2, a feeder unit 3, and an image forming unit 4.

The main body 2 is a casing having an opening 2A formed on a front side thereof, and a swing-openable and closable front cover 21 is attached to cover the opening 2A. A top section of the main body 2 is formed to serve as a sheet-discharge tray 2, in which a sheet with a printed image is ejected.

The feeder unit 3 includes sheet-feed tray 31 and a sheet-feeding system 32. In the feeder unit 3, sheets stored in the sheet-feed tray 31 is picked up one-by one separately by the sheet feeding system 32 to be carried to the image forming unit 4.

The image forming unit 4 includes a scanner unit 41, a plurality of (e.g., four) processing cartridges 42, a belt unit 43, and a fixing unit 44.

The scanner unit 41 includes laser-beam emitters (not shown), polygon mirrors, lenses, and reflection mirrors, which are not indicated by reference sings. The laser beams emitted from the laser-beam emitters, which are indicated by double-dotted lines in FIG. 1, are reflected on the polygon mirrors and reflection mirrors and transmit through the lenses to be casted to scan on surfaces of photosensitive drums 51 in the processing cartridges 42.

The processing cartridges 42 are detachably attached in a drawer 43, which can be installed in and pulled out of the main body 2 through the opening 2A. Each of the processing cartridges 42 includes a drum cartridge 5, a developer device 6, and a developer agent cartridge 7. The developer device 6 is detachably attached to the drum cartridge 5, and the developer agent cartridge 7 is detachably attached to the developer device 6. The drum cartridge 5 includes a photosensitive drum 51 and a charger 52.

Figure 2:
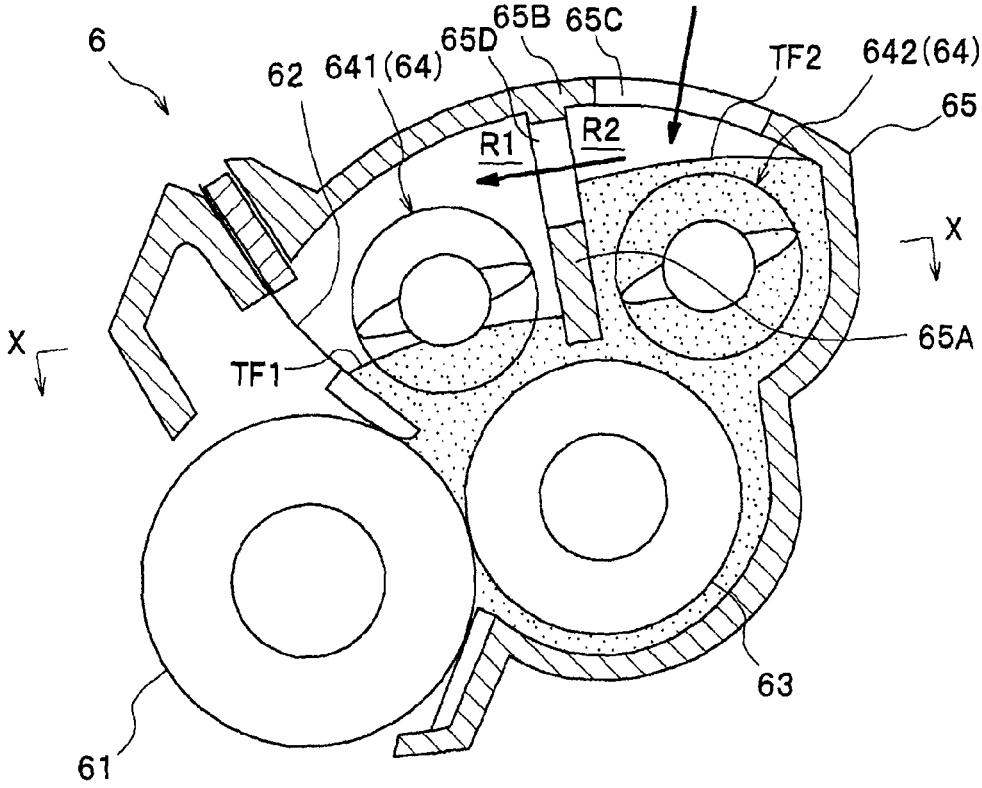
FIG. 2 is a cross-sectional side view of one of the developer units according to the embodiment of the present invention.
Figure 3:
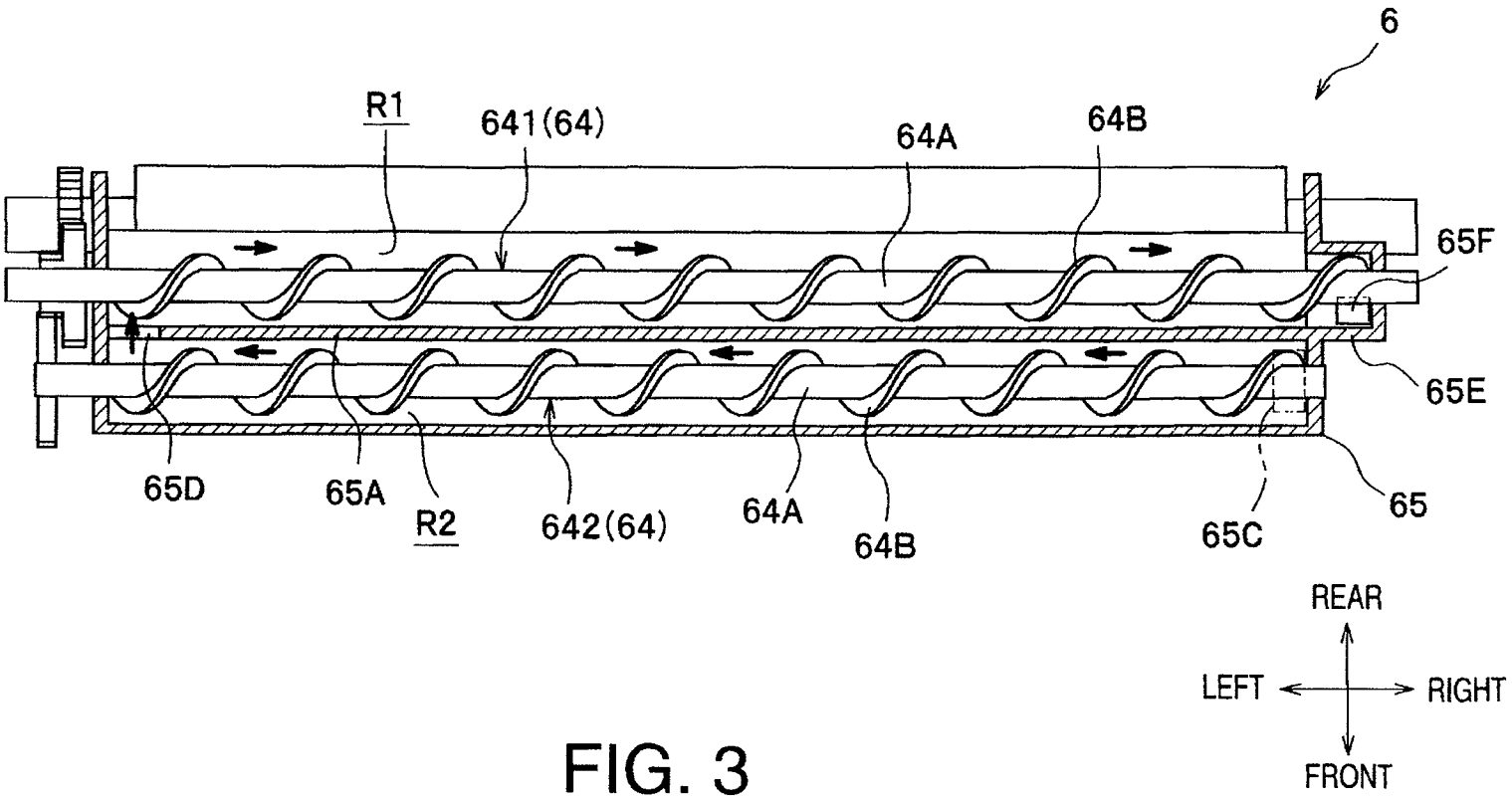
FIG. 3 is a cross-sectional view of the developer unit according to the embodiment of the present invention taken from a line X-X shown in FIG. 2.

As shown in FIG. 2, the developer device 6 includes a developer roller 61, a spreader blade 62, and a supplier roller 63. The developer roller 61 rotatably carries toner being a developer agent on a surface thereof. The spreader blade 62 scrapes the surface of the developer roller 61 to spread the toner evenly on the surface of the developer roller 61 in a layer and restricts thickness of the toner layer. The supplier roller 63 rotatably supplies the toner to the developer roller 61.

The developer agent cartridge 7 (see FIG. 1) therein contains the toner to be supplied to the developer device 6. The toner in the developer agent cartridge 7 is fed to the developer device 6, which is arranged in a lower adjacent position with respect to the developer agent cartridge 7.

In the processing cartridge 42 with the above configuration, the toner fed from the developer agent cartridge 7 to the developer device 6 is supplied to the developer roller 61 via the supplier roller 63. In this regard, the toner between the supplier roller 63 and the developer roller 61 is positively charged and spread evenly in a layer by the spreader blade 62, which scrapes the surface of the developer roller 61. Thus, the toner is applied to the surface of the developer roller 61 in the predetermined thickness.

Meanwhile, in the drum cartridge 5, the charger 52 positively charges the surface of the photosensitive drum 51 evenly, and the surface of the photosensitive drum 51 is exposed to the laser beam emitted from the laser-beam emitter of the scanner unit 41 based on image data representing an image to be formed. Thus, electric potential is lowered in the regions exposed to the laser beam, and an electrostatic latent image corresponding to the image to be formed is formed on the surface of the photosensitive drum 51. When the electrostatic latent image comes in contact with the positively charged toner on the surface of the developer roller 61, the toner adheres onto the latent image, and a toner image is formed on the surface of the photosensitive drum 51.

The belt unit 43 includes a conveyer belt 43A being an endless belt to carry the sheet, and transfer rollers 43B, which are arranged in positions to be in contact with an upper-inner surface of the conveyer belt 43 to nip the conveyer belt 43A with the photosensitive drums 51. When the sheet is conveyed between the photosensitive drums 51 and the transfer rollers 43B by the conveyer belt 43A, the toner images formed on the photosensitive drums 51 are sequentially transferred onto the sheet to be overlaid. Whilst the toner images on the photosensitive drums 51 are formed in different colors, when the sheet passes through the photosensitive drums 51 and the transfer rollers 43B, an image in colors is formed on the sheet.

The fixing unit 44 includes a heat roller 44A and a pressure roller 44B. The pressure roller 44B is arranged in a position opposite from the heat roller 44A and presses the sheet against the heat roller 44A. When the sheet with the colored image is carried in between the heat roller 44A and the pressure roller 44B, the colored image is thermally fixed onto the sheet. The sheet with the image fixed thereon is further carried and directed by a discharge roller 46 to the discharge tray 22.

Configurations of the Developer Device and the Developer Agent Cartridge

Next, the developer device 6 and the developer agent cartridge 7 will be described in detail. In the present embodiment, the developer device 6 and the developer agent cartridge 7 attached to each other constitute the developer unit DU (see FIGS. 1 and 4).

As shown in FIG. 2, the developer device 6 includes the developer roller 61, the spreader blade 62, and the supplier roller 63. Further, the developer device 6 includes two augers 64 to convey the toner and a shell 65 to accommodate the components.

The spreader blade 62 is arranged in an upper position with respect to the supplier roller 63 (in particular, in an upper position with respect to a point in which the supplier roller 63 comes in contact with the developer roller 61).

The augers 64 are arranged to extend in parallel with each other and with an axis of the supplier roller 63 along a circumference of the supplier roller 63 to carry the toner along the axial direction of the supplier roller 63. The augers 64 include a first auger 641 and a second auger 642. In particular, the first auger 641 is arranged in an upper position with respect to the supplier roller 63 and in adjacent to the spreader blade 62. The second auger 642 is arranged in an upper position with respect to the supplier roller 63 and in adjacent to the first auger 641 via a partition wall 65A. As shown in FIG. 2, the first auger 641 and the second auger 642 are arranged along the circumference of the supplier roller 63, and at the same time, the first auger 641 and the second augers 642 are aligned in horizontally substantially equivalent level in the upper position with respect to the supplier roller 63.

Each of the augers 64 has a shaft 64A and a spiral 64B, which twines around the shaft 64A. According to the present embodiment, the first auger 641 is rotated in one direction to convey the toner from left to right, and the second auger 642 is rotated in an opposite direction to convey the toner from right to left (see FIG. 3).

The developer device 6 includes a first room R1, which accommodates the first auger 641, and a second room R2, which accommodates the second auger 642. A partition wall 65A substantially divides the first room R1 and the second room R2 and intervenes between the first auger 641 and the second auger 642. According to the present embodiment, the developer device 6 is designed to maintain levels of surfaces of toner in the first room R1 and the second room R2 to be different from each other. In particular, a level TF1 of the toner in the first room R1 is set to be lower than a level TF2 of the toner in the second room R2 when the first and second augers 641, 642 are driven.

More specifically, the shell 65 is formed to have a feeding hole 65C, through which the toner from the developer cartridge 7 is supplied to the second room R2 of the developer device 6, on a right-hand side in a top surface 65B of the shell 65. (The right-hand side in the top surface 65B refers to an upstream side of a second auger toner-conveying flow, which is a flow of the toner caused by the second auger 642.) Meanwhile, the partition wall 65A is formed to have a communication hole 65D, through which the toner is passed from the second room R2 to the first room R1, on a left-hand side thereof (see FIGS. 2 and 3). (The left-hand side of the partition wall 65A refers to a downstream side of the second auger toner-conveying flow.)

Figure 4:
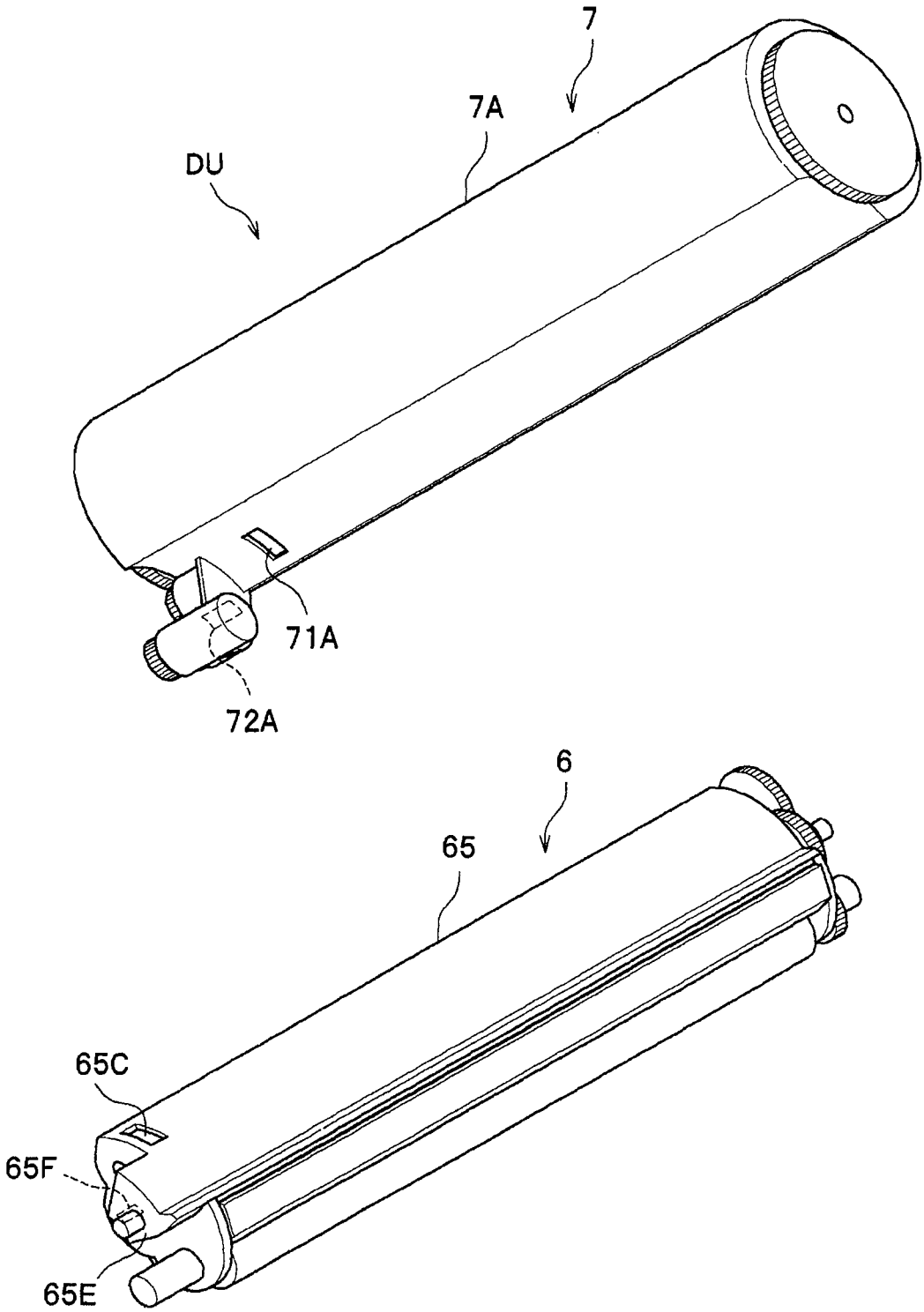
FIG. 4 is an exploded view of the developer unit according to the embodiment of the present invention.

Further, the shell 65 is formed to have a protrusive frame 65E, which surrounds the right-side end of the first auger 641, on the right-hand end thereof (i.e., on a downstream side of a first auger toner-conveying flow). On a lower surface of the protrusive frame 65E, a collecting hole 65F, through which the toner in the first room R1 is returned to the developer agent cartridge 7, is formed (see FIGS. 3 and 4). FIG. 4 (and in FIG. 11) is an exploded view of the developer unit DU, in which the developer agent cartridge 7 is viewed from a lower position, and the developer device 6 is viewed from an upper position.

Figure 5:
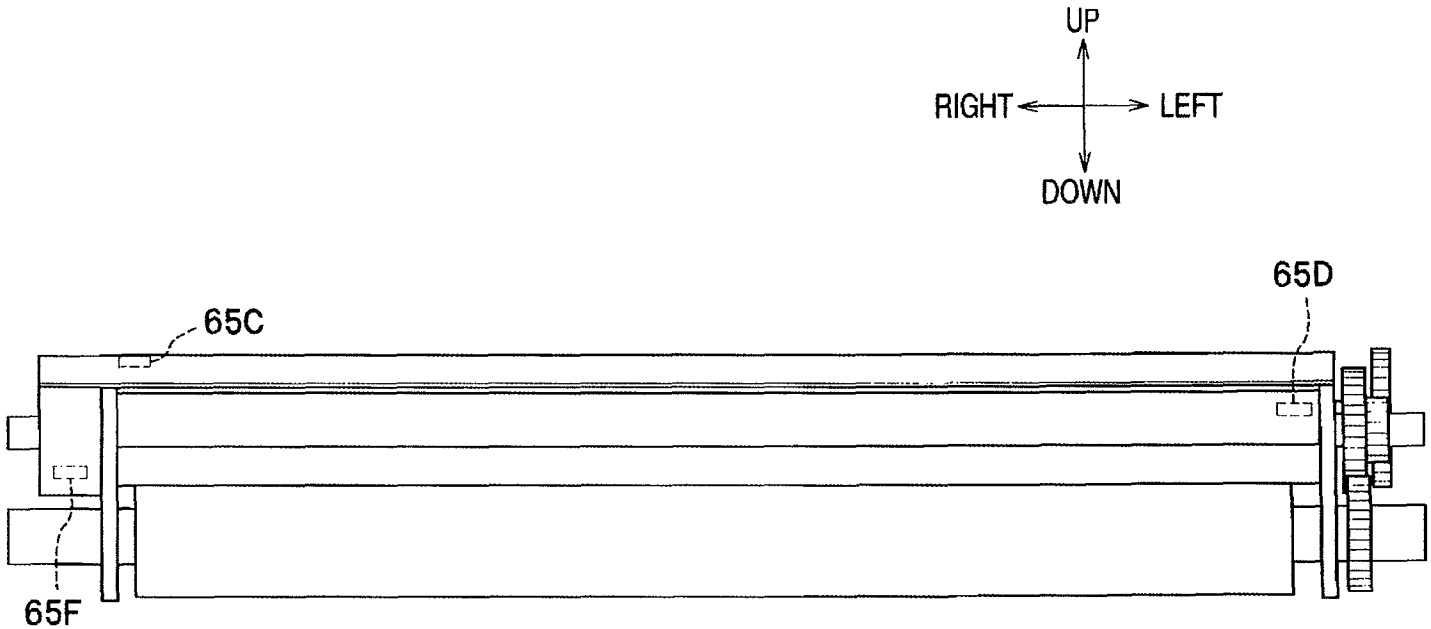
FIG. 5 is a rear view of a developer device according to the embodiment of the present invention.

As shown in FIG. 5, the communication hole 65D is formed in a higher position with respect to the collecting hole 65F. Therefore, the toner supplied to the second room R2 through the feeding hole 65C is accumulated in the second room R2 until the level TF2 reaches the height of the communication hole 65D. When the toner reaches the communication hole 65D, the toner is moved out of the second room R2 through the communication hole 65D and supplied to the first room R1. The toner entering the first room R1 is constantly conveyed by the first auger 641 toward the collecting hole 65F and moved out of the first room R1 through the collecting hole 65F to be returned to the developer agent cartridge 7. Thus, the level TF1 of the toner in the first room R1 is maintained to be lower than the level TF2 of the toner in the second room R2.

Further, in order to secure the level difference between the level TF1 and the TF2 in the first room R1 and the second room R2, in the present embodiment, the first auger 641 is designed to have higher capacity of conveying the toner than toner-conveying capacity of the second auger 642. (In the present embodiment, the toner-conveying capacity refers to an amount of the toner to be carried per unit of time.) Therefore, the amount of toner being discharged out of the first room R1 is greater than the amount of toner being transferred from the second room R2 to the first room R1. Accordingly, the level difference between the level TF1 and the TF2 in the first room R1 and the second room R2 is secured.

Furthermore, the toner-conveying capacities can be differentiated by, for example, setting different rotation velocities to the augers 64. For another example, different sizes and/or angles of the spirals 64B of the augers 64 can cause difference in the toner-conveying capacities.

Figure 6A:
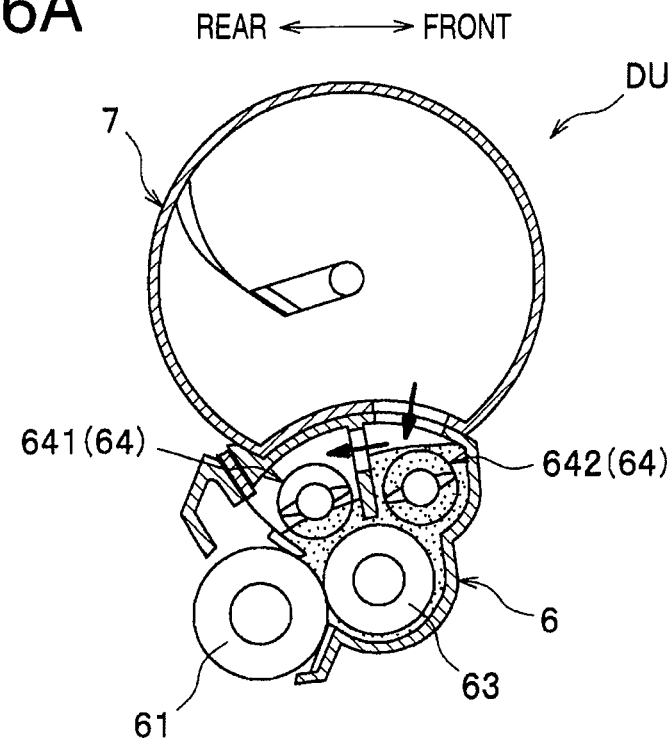
FIG. 6A is a cross-sectional side view of the developer unit according to the embodiment of the present invention.
Figure 6B:
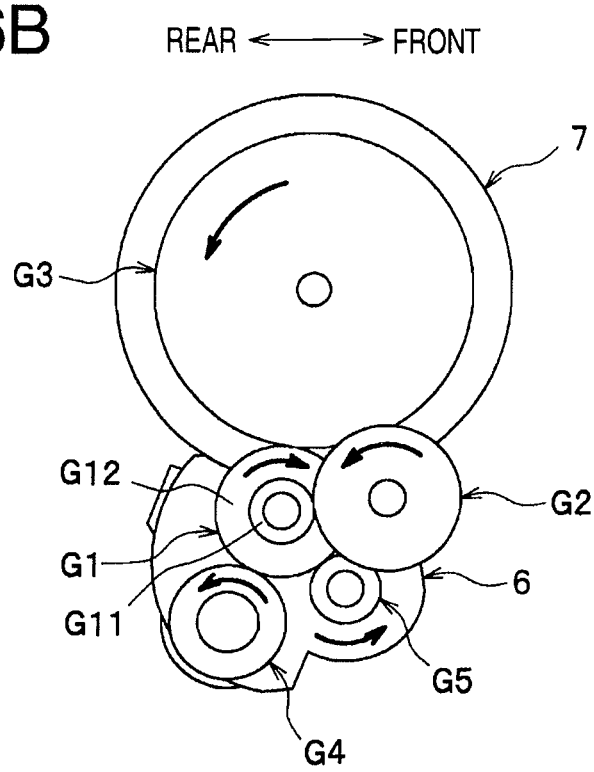
FIG. 6B is a side view to illustrate engagement of gears in the developer unit according to the embodiment of the present invention.

In the present embodiment, reduction gears are provided in order to set different rotation velocities to the augers 64. That is, as shown in FIGS. 6A and 6B, the first auger 641 is provided with a stepped gear G1, which is an integrally rotatable reduction gear, on a left-side end thereof. A smaller-diameter gear G11 of the stepped gear G1 is engaged with a gear G2, which is provided to a left-side end of the second auger 642 to be integrally rotatable along with the second auger 642. The gear G2 is formed to have a diameter being substantially equivalent to a diameter of a larger-diameter gear G12 of the stepped gear G1. With this gear configuration, the first auger 641 is rotated in a higher rotation velocity than a rotation velocity of the second auger 642.

Meanwhile, the larger diameter gear G12 of the stepped gear G1 is engaged with a gear G3, a gear G4, and a gear G5. The gear G3 is integrally rotatable along with a rotation shaft A11 (see FIG. 7A) of an agitator A1 (see FIGS. 7A, 7B). The gear G4 is integrally rotatable along with a rotation shaft (not shown) of the developer roller 61. The gear G5 is integrally rotatable along with a rotation shaft (not shown) of the supplier roller 63. Therefore, when driving force from one of the agitator A1, the developer roller 61, and the supplier roller 63 is transmitted, one of the gears G3-G5 is rotated, and the first and second augers 641, 642 are rotated in different rotation velocities.

The agitator A1 and agitators A2-A4 are set inside a toner case 7A of the developer agent cartridge 7. The agitators A1-A4 stir and convey the toner in the toner case 7A (see FIGS. 7A 7B).

The toner case 7A is a cylindrical toner container 71 and a collecting flow path 72, in which the toner to be collected is conveyed. In a lower surface of the toner container 71, a feeding hole 71A is formed. The feeding hole 71A is an opening having a size corresponding to a size of the feeding hole 65C of the shell 65 and is formed in a position corresponding to the position of the feeding hole 65C (see also FIG. 4).

The collecting flow path 72 is formed on one (i.e., right) side end of the toner container 71. The collecting flow path 72 droops downwards from the right-side end of the container 71 and extends laterally (in the right-left direction) from a lower end of the droop. In a top surface of the laterally extending portion, a collecting hole 72A is formed. The collecting hole 72A is an opening having a size corresponding to a size of the collecting hole 65F of the shell 65 and is formed in a position corresponding to the position of the collecting hole 65F (see also FIG. 4).

The agitator A1 stirs the toner in the toner container 71 and supplies the toner to the developer device 6. The agitator A1 includes a rotation shaft A11, which is rotatably supported by lateral (i.e., right and left) walls of the toner container 71, a plurality of films A12, A13, which are fixed to the rotation shaft A11. When the agitator A1 rotates, free ends of the films A12, A13 sweep an inner surface of the toner container 71. Amongst the films A12, A13, the film A12 is arranged in a position corresponding to the feeding hole 71A and formed to have a shape of rectangle. The remaining films A13 other than the film A12 are fixed to the rotation shaft A11 and arranged in angled orientation, in which the films A13 can sweep and collect the toner in the toner container 71 toward the feeding hole 71A. More specifically, each film A13 is oriented to have its surfaces angled with respect to the rotation shaft A11 so that its one edge closer to the feeding hole 71A projects frontward with respect to a rotation direction of the agitator A1 and with an opposite edge further from the feeding hole 71A recedes rearward with respect to the rotation direction of the agitator A1. In other words, the edge closer to the feeding hole 71A travels ahead of the opposite edge which is further from the feeding hole 71A as the agitator A1 rotates.

The collecting flow path 72 is divided into three rooms R3, R4, R5, and inside the rooms R3, R4, R5, the agitators A2, A3, and A4 to convey the toner upward are respectively arranged. In particular, the agitator A2 includes a rotation shaft A21 and two conveyer films A22, which are fixed to the rotation shaft A21 and convey the toner upward. Similarly, the agitator A3 includes a rotation shaft A31 and two conveyer films A32. The agitator A4 includes a rotation shaft A41 and two conveyer films A42. The agitator A4, which is in a lowermost position amongst the agitators A2-A4, is further provided with a film A43. The film A43 is fixed to the rotation shaft A41 and in angled orientation to move the toner in the vicinity of the collecting hole 72A toward the conveyer films A42. More specifically, an edge of the film A43 further from the conveyer films A42 protrudes frontward with respect to a rotation direction of the agitator A4 and an opposite edge closer to the conveyer films A42 recedes rearward with respect to the rotation direction of the agitator A4. That is, the edge of the film A43 further from the conveyer films A42 travels ahead of the opposite edge which is closer to the conveyer films A42.

The agitators A1, A2, A3, A4 are respectively provided with integrally rotatable gears G21, G22, G23, G24 on one end thereof (see FIG. 8B). The gears G21-G24 are mutually engaged with adjoining gears. Whilst the adjoining gears rotate in opposite directions, the agitators A1-A4 connected with the gears G21-G24 rotate in opposite directions from an adjoining agitator.

With the above difference in directions of rotation, the agitator A2-A4 can pass the toner to an upper room, and the toner is carried upward to the toner container 71. For example, as the agitator A4 in the lowermost room R5 rotates, the conveyer films A42 move toward a path R51, which connects the room R5 and the room R4. Accordingly, the toner is uplifted and tossed toward the path R51. Thereafter, the conveyer films A42 move further away from the path R51. Meanwhile, in the upper room R4, the agitator A3 rotates in a direction opposite from the agitator A4, and the conveyer films A32 move the tossed toner away from the path R51. Therefore, a reverse flow of the toner from the upper room R4 to the lower room R5 is prevented.

When the toner enters the collecting flow path 72 through the collecting hole 72A (see FIG. 7A), the toner is carried upward in the collecting flow path 72 by the agitators A2-A4 to the toner container 71. The toner retrieved in the toner container 71 is conveyed toward the feeding hole 71A by the films A13 of the agitator A1 and pushed downward by the film A12 to the developer device 6 through the feeding hole 71A. Thus, the toner is circulated in the developer unit DU between the developer agent container 7 and the developer device 6. In this regard, toner-conveying capacity of the agitators A2-A4 is set to be higher than the toner-conveying capacity of the augers 64.

According to the above configuration, the augers 64 are arranged in parallel with the supplier roller 63 and along the circumference of the supplier roller 63; therefore, retention of the toner in areas neighboring the supplier roller 63 can be prevented. For example, when a developer unit is provided with solely a single auger to convey the toner in one direction, density of the toner around the auger may vary depending on a design and a shape of the single auger. The uneven density of the toner around the auger may cause uneven toner supply to the supplier roller 63 and the developer roller 61. However, with the first auger 641, which supplies the toner to the supplier roller 63, and the second auger 642, which is arranged in parallel with the first auger 641 and stirs the toner to be supplied to the first auger 641, uneven toner supply to the supplier roller 63 and the developer roller 61 can be restrained.

Further, when the first and second augers 641, 642 are driven, the level TF1 of the toner in the first room R1 becomes lower than the level TF2 of the toner in the second room R2. In other words, the second room R2 containing a greater amount of toner is subject to higher pressure, whilst the first room R1 containing a smaller amount of toner is subject to lower pressure. Therefore, pressure of the toner on the contact area of the developer roller 61 and the spreader blade 62 is reduced to be lower. When the contact area is subject to the lower pressure, leakage of the toner through the contact area due to higher pressure can be prevented, and uneven toner supply to the developer roller 61 can be prevented.

Further, according to the above configuration, the communication hole 65D in the partition wall 65A between the first room R1 and the second room R2 is formed in the higher position with respect to the collecting hole 65F, through which the toner in the first room R1 is returned to the developer agent cartridge 7. Therefore, the level TF1 of the toner in the first room R1 can be securely maintained to be lower than the level TF2 of the toner in the second room R2.

Furthermore, according to the above configuration, the toner-conveying capacity of the first auger 641 is set to be higher than the toner-conveying capacity of the second auger 642; therefore, the level TF1 of the toner in the first room R1 can be maintained even more securely to be lower than the level TF2 of the toner in the second room R2.

Although an example of carrying out the invention has been described, those skilled in the art will appreciate that there are numerous variations and permutations of the developer unit that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiment, the toner in the developer unit DU is circulated in a single route, which includes the feeding hole 65C, the second room R2, the communication hole 65D, the first room R1, and the collecting hole 65F. However, the toner may be circulated in two routes, which are shown in FIGS. 9-11. Description of the two routes will be provided below. In the following description, components similar to those included in the developer unit DU of the previous embodiment will be referred to by the same reference signs, and description of those will be omitted.

In the developer unit DU with the two circulation routes, the augers 64 aligned in parallel with each other along the circumference of the supplier roller 63, but unlike the augers in the previous embodiment, the first auger 641 is arranged in an opposite orientation from the orientation of the first auger 641 in the previous embodiment. That is, the spiral 64B of the second auger 642 is directed in the same direction as the spiral 64B of the first auger 641. Therefore, the first auger 641 and the second auger 642 convey the toner in the same direction from left to right (see FIG. 10).

The shell 65 is formed to have a first feeding hole 65G, through which the toner from a toner case 7A is supplied to the first room R1, and a second feeding hole 65H, through which the toner from the toner case 7A is supplied to the second room R2, in a left side (i.e., an upstream side of the toner-conveying flow for the augers 64) of the top surface 65B. In this regard, the toner case 7A is formed to have a first feeding hole 71G and a second feeding hole 71H in positions corresponding to the first feeding hole 65G and the second feeding hole 65H of the shell 65.

Further, as shown in FIGS. 10 and 11, the shell 65 is formed to have a first collecting hole 65K and a second collecting hole 65L in a right-side end of a wall 65J, which faces right-side ends of the augers 64. (The right-side end of the augers 64 refers to downstream ends of the toner-conveying flow for the augers 64.) The collecting hole 65K is an opening, through which the toner in the first room R1 is retrieved in the toner case 7A, and a second collecting hole 65L is an opening, through which the toner in the second room R2 is retrieved in the toner case 7A. In this regard, the toner case 7A is formed to have a first collecting hole 71K and a second collecting hole 71L in positions corresponding to the first collecting hole 65K and the second collecting hole 65L of the shell 65.

With this configuration, the toner is supplied to the first room R1 and the second room R2 through the first and second feeding holes 65G, 65H respectively. Further, the toner is retrieved in the toner case 7A through the first room R1 and the second room R2 through the first and second collecting holes 65K, 65L.

In this regard, the second feeding hole 65H is formed to have a larger opening than the opening of the first feeding hole 65G. In other words, a greater amount of toner is supplied to the second room R2 through the larger second feeding hole 65H than an amount of the toner supplied to the first room R1 through the smaller first feeding hole 65G in a same time period. Therefore, the level TF1 of the toner in the first room R1 is maintained to be lower than the level TF2 of the toner in the second room R2 (see FIG. 9).

Further, the second collecting hole 65L is formed to have a smaller opening than the opening of the first collecting hole 65K. In other words, a smaller amount of toner is discharged out of the second room R2 through the smaller second collecting hole 65L than an amount of the toner discharged out of the first room R1 through the larger first collecting hole 65K in a same time period. Therefore, the level TF1 of the toner in the first room R1 is even more securely maintained to be lower than the level TF2 of the toner in the second room R2 (see FIG. 10).

In the above-described example, the feeding holes 65G, 65H are formed in different sizes, and the collecting holes 65K, 65L are formed in different sizes at the same time. However, either the feeding holes 65G, 65H or the collecting holes 65K, 65L may be formed in different sizes. For example, the first and second feeding holes 65G, 65H may be formed in different sizes, and the first and second collecting holes 65K, 65L may be formed in a same size.

Alternatively, the first and second feeding holes 65G, 65H may be formed in a same size, and the first and second collecting holes 65K, 65L may be formed in a same size. Even when the first and second feeding holes 65G, 65H are formed in a same size, and the first and second collecting holes 65K, 65L are formed in a same size, as long as the first auger 641 is designed to have higher toner-conveying capacity than the toner-conveying capacity of the second auger 642, the level TF1 of the toner in the first room R1 is maintained to be lower than the level TF2 of the toner in the second room R2.

In the above-described embodiments, in order to secure the level difference of the level TF1 of the toner in the first room R1 and the level TF2 of the toner in the second room R2, the communication hole 65D is formed in the position higher than the collecting hole 65F, and at the same time the first auger 641 is designed to have the higher toner-conveying capacity than the second auger 642. However, the communication hole 65D may be formed in the higher position whilst the first auger 641 is designed to have a toner-conveying capacity equivalent to the toner-conveying capacity of the second auger 642. Alternatively, the communication hole 65D may be formed in a same level as a level of the collecting hole 65F whilst the first auger 641 is designed to have the higher toner-conveying capacity than the second auger 642.

Alternatively or additionally, for example, the first room R1 may be formed to be substantially greater than the second room R2 so that the level TF1 of the toner in the first room is lowered than the level TF2 of the toner in the second room R2 in a same time period even when the toner-conveying capacities of the first auger 641 and the second auger 642 are equivalent.

In the above-described embodiments, the developer unit DU includes two detachable parts, which are the developer device 6 and the developer agent container 7. However, a developer unit DU having a developer agent container undetachably fixed to the developer device may be provided.

In the above-described embodiments, the developer unit DU includes two augers 64. However, a number of the augers 64 is not limited to two but may be, for example, three or more.

The spreader blade 62 described in the above embodiments may be a metal plate with a rubber edge. Alternatively, for example, the spreader blade 62 may be a solid metal plate without rubber.

In the above-described embodiments, the printer 1 being an image forming apparatus having the developer unit according to the present invention is described. However, the image forming apparatus may be, for example, a copier and a printer.

In the above-described embodiments, the agitators A2-A4 are employed to return the toner from the developer device 6 to the toner container 71. However, the agitators A2-A4 to convey the toner from the developer device 6 to the toner container 71 may be replaced with, for example, augers.

What is claimed is:

1. A developer unit for an image forming apparatus, comprising:

a developer device having a developer roller, which rotatably carries a developer agent on a surface thereof, a supplier roller, which supplies the developer agent to the developer roller, and a restricting member, which scrapes the surface of the developer roller to restrict thickness of the developer agent on the surface of the developer roller;

a developer agent container, which contains the developer agent; and a plurality of conveyers, including a first conveyer and a second conveyer, to convey the developer agent in an axial direction of the supplier roller, both of the first conveyer and the second conveyer being disposed between the supplier roller and the developer agent container along a vertical direction of the image forming apparatus, wherein a distance between the first conveyer and the supplier roller is substantially equal to a distance between the second conveyer and the supplier roller, wherein the second conveyer is arranged along a circumference of the supplier roller and arranged in parallel with the first conveyer, wherein the developer device is formed to have a first room to accommodate the first conveyer, a second room to accommodate the second conveyer, and a partition wall to divide the first room and the second room; and wherein the developer device is configured to have a level of the developer agent in the first room to be lower than a level of the developer agent in the second room when the developer roller, the supplier roller, and the first and second conveyers are driven.

2. The developer unit according to claim 1, wherein the restricting member is arranged in a position higher than the supplier roller;

wherein the developer agent container is arranged adjacent to the developer device in the developer unit; and wherein the first conveyer is arranged in an upper position with respect to the supplier roller and adjacent to the restricting member.

3. The developer unit according to claim 1, wherein the developer device is formed to have a feeding opening, through which the developer agent in the developer agent container is supplied to the second room;

wherein the partition wall of the developer device is formed to have a communication opening, through which the developer agent in the second room is transferred to the first room, in a downstream side of a developer agent conveying flow for the second conveyer;

wherein the first room of the developer device is formed to have a collecting opening, through which the developer agent in the first room is returned to the developer agent container, in a downstream side of a developer agent conveying flow for the first conveyer; and wherein the communication opening is formed in an upper position with respect to the collecting opening.

4. The developer unit according to claim 1, wherein the developer device is formed to have:

a first feeding opening, through which the developer agent is supplied from the developer agent container to the first room; and a second feeding opening, through which the developer agent is supplied from the developer agent container to the second room, wherein a size of the second feeding opening is larger than a size of the first feeding opening.

5. The developer unit according to claim 1, wherein the developer device is formed to have:

a first collecting opening, through which the developer agent in the first room conveyed by the first conveyer to a downstream side for the first conveyer is returned to the developer agent container; and a second collecting opening, through which the developer agent in the second room conveyed by the second conveyer to a downstream side for the second conveyer is returned to the developer agent container;

wherein a size of the second collecting opening is smaller than a size of the first collecting opening.

6. The developer unit according to claim 1, wherein the developer device is formed to have a feeding opening, through which the developer agent in the developer agent container is supplied to the second room;

wherein the partition wall of the developer device is formed to have a communication opening, through which the developer agent in the second room is transferred to the first room, in a downstream side of a developer agent conveying flow for the second conveyer;

wherein the first room of the developer device is formed to have a collecting opening, through which the developer agent in the first room is returned to the developer agent container, in a downstream side of a developer agent conveying flow for the first conveyer; and wherein the first conveyer has greater capability to convey the developer agent than capability of the second conveyer to convey the developer agent.

7. The developer unit according to claim 6, wherein the first conveyer conveys a greater amount of developer agent than an amount of the developer agent to be conveyed by the second conveyer per unit of time.

8. The developer unit according to claim 1, wherein the developer device is formed to have:

a first feeding opening, through which the developer agent is supplied from the developer agent container to the first room;

a second feeding opening, through which the developer agent is supplied from the developer agent container to the second room;

a first collecting opening, through which the developer agent in the first room conveyed by the first conveyer to a downstream side for the first conveyer is returned to the developer agent container; and a second collecting opening, through which the developer agent in the second room conveyed by the second conveyer to a downstream side for the second conveyer is returned to the developer agent container;

wherein the first conveyer has greater capability to convey the developer agent than capability of the second conveyer to convey the developer agent.

9. The developer unit according to claim 8, wherein the first conveyer conveys a greater amount of developer agent than an amount of the developer agent to be conveyed by the second conveyer per unit of time.

* * * * *